US010167868B2

(12) United States Patent
Fukushima et al.

(10) Patent No.: US 10,167,868 B2
(45) Date of Patent: Jan. 1, 2019

(54) SCREW COMPRESSOR

(71) Applicant: Kobe Steel, Ltd., Hyogo (JP)

(72) Inventors: Yosuke Fukushima, Kobe (JP); Kazuki Tsugihashi, Kobe (JP)

(73) Assignee: Kobe Steel, Ltd., Hyogo (JP)

( * ) Notice: Subject to any disclaimer, the term of this patent is extended or adjusted under 35 U.S.C. 154(b) by 181 days.

(21) Appl. No.: 15/123,555

(22) PCT Filed: Feb. 9, 2015

(86) PCT No.: PCT/JP2015/053543
§ 371 (c)(1),
(2) Date: Sep. 2, 2016

(87) PCT Pub. No.: WO2015/137028
PCT Pub. Date: Sep. 17, 2015

(65) Prior Publication Data

US 2017/0074266 A1 Mar. 16, 2017

(30) Foreign Application Priority Data

Mar. 10, 2014 (JP) ..... 2014-046718

(51) Int. Cl.
*F04C 29/00* (2006.01)
*F04C 23/00* (2006.01)
(Continued)

(52) U.S. Cl.
CPC ..... *F04C 29/0071* (2013.01); *F01C 21/10* (2013.01); *F04C 18/16* (2013.01);
(Continued)

(58) Field of Classification Search
CPC .... F01C 21/10; F04C 2240/30; F04C 29/005; F04C 29/0071
See application file for complete search history.

(56) References Cited

U.S. PATENT DOCUMENTS 4,153,397 A * 5/1979 Allen ..... F04C 15/0061 418/48
6,073,517 A 6/2000 Pauwels et al.
(Continued)

FOREIGN PATENT DOCUMENTS

CN 201851379 U 6/2011
CN 202360682 U 8/2012
(Continued)

OTHER PUBLICATIONS

International Search Report issued in PCT/JP2015/053543; dated May 19, 2015.
(Continued)

*Primary Examiner* — Mary A Davis
(74) *Attorney, Agent, or Firm* — Studebaker & Brackett PC

(57) ABSTRACT

A screw compressor includes compressor bodies, a motor disposed in a side of the compressor bodies, a gear box coupled to the compressor bodies and transmitting the drive force of the motor to a screw rotor, and a tubular coupling casing coupling the gear box and the motor and having horizontal axis. The coupling casing has a work hole in the horizontal direction. The work hole is used for maintaining a coupling accommodated in the coupling casing. The coupling casing has a rib extending in the up-down direction. It is thus possible to avoid reduction in the rigidity of the coupling casing with no cost increase, and to improve maintainability.

6 Claims, 13 Drawing Sheets

(51) Int. Cl.
*F01C 21/10* (2006.01)
*F04C 18/16* (2006.01)

(52) U.S. Cl.
CPC ..... *F04C 23/001* (2013.01); *F04C 29/005* (2013.01); *F04C 29/0085* (2013.01); *F04C 2240/30* (2013.01); *F04C 2240/40* (2013.01); *F04C 2240/60* (2013.01); *F04C 2240/70* (2013.01)

(56) References Cited

U.S. PATENT DOCUMENTS

| | | | | |
|---|---|---|---|---|
| 6,926,492 | B2 * | 8/2005 | Hegebarth | F04C 2/086 415/111 |
| 2009/0260357 | A1 | 10/2009 | Prior | |
| 2013/0011285 | A1 * | 1/2013 | Achtelik | F04C 29/04 418/10 |

FOREIGN PATENT DOCUMENTS

| | | | |
|---|---|---|---|
| JP | H06-193573 | A | 7/1994 |
| JP | H10-318159 | | 12/1998 |
| JP | 2011-001937 | A | 1/2011 |
| JP | 2011-226285 | A | 11/2011 |
| WO | 2005/042980 | A1 | 5/2005 |
| WO | 2011/093135 | A1 | 8/2011 |

OTHER PUBLICATIONS

Written Opinion issued in PCT/JP2015/053543; dated May 19, 2015.

Notification of Transmittal of Translation of the International Preliminary Report on Patentability and Translation of Written Opinion of the International Searching Authority; PCT/JP2015/053543 dated Sep. 22, 2016.

* cited by examiner

SCREW COMPRESSOR

CROSS-REFERENCE TO RELATED APPLICATIONS

This is a national phase application in the United States of International Patent Application No. PCT/JP2015/053543 with an international filing date of Feb. 9, 2015, which claims priority of Japanese Patent Application No. 2014-046718 filed on Mar. 10, 2014 the contents of which are incorporated herein by reference.

TECHNICAL FIELD

The present invention relates to a screw compressor.

BACKGROUND ART

To improve maintainability, Japanese Patent Application Publication (JP-A) No. 06-193573 discloses a screw compressor having a coupling casing coupling a compressor body and a motor, in which a motor shaft and a rotor shaft are fastened by shaft couplings in the coupling casing.

The screw compressor is of the vertical type in which the motor is disposed above the compressor body. The screw compressor having the above configuration is also of the horizontal type in which the motor is disposed in a side of the compressor body.

In the screw compressor of the horizontal type having the coupling casing, part of the weight of the motor is applied, as a load, to the motor side coupling portion of the coupling casing. In addition, since the motor and the compressor body vibrate during operation, this causes a force to act on the coupling casing. In particular, the stress in the vertical direction is large.

To further improve the maintainability of the shaft couplings in the coupling casing, a work hole is provided in the coupling casing.

When the work hole is provided in the coupling casing, the shear rigidity in the vertical direction of the coupling casing is significantly reduced. Reduction in rigidity leads to larger vibration and breakage. As a simple solution for this, to compensate for the rigidity, the thickness of the tubular portion of the coupling casing is increased, or a radial rib is provided in the tubular portion of the coupling casing. However, both of increase in the thickness of the tubular portion and addition of the radial rib make the weight of the material larger, resulting in cost increase.

SUMMARY OF THE INVENTION

Problems to be Solved by the Invention

An object of the present invention is to provide a screw compressor having a coupling casing coupling a screw compressor body and a motor driving the screw compressor body, the screw compressor avoiding reduction in the rigidity of the coupling casing with no cost increase, and improving maintainability.

Means for Solving the Problems

As means for solving the above problems, a screw compressor of the present invention has a compressor body compressing a fluid by a screw rotor, a motor disposed in a side of the compressor body and supplying a drive force to the compressor body, a gear box coupled to the compressor body and transmitting the drive force of the motor to the screw rotor, a tubular coupling casing coupling the gear box and the motor and having a horizontal axis, an input shaft coupled to the shaft of the motor and inputting the drive force of the motor to the gear box, a coupling accommodated in the coupling casing and coupling the input shaft and the shaft of the motor, a work hole in the horizontal direction provided in the coupling casing and used for maintaining the coupling, and a rib provided in the coupling casing and extending in the up-down direction.

With this configuration, since the coupling casing has the work hole in the horizontal direction, and the rib extending in the up-down direction, it is thus possible to avoid reduction in the rigidity of the coupling casing with no cost increase, and to improve maintainability. In particular, since the coupling casing has the rib extending in the up-down direction, it is thus possible to improve the shear rigidity in the vertical direction of the coupling casing, and to avoid reduction in the rigidity of the coupling casing. The meaning of the up-down direction herein is not limited to only the vertical direction, but includes the direction in which the rib is tilted within the range that can obtain substantially the same effect of improving the shear rigidity in the vertical direction and avoiding reduction in the rigidity of the coupling casing, as the rib extending in the vertical direction.

Preferably, the rib extends in the vertical direction. With this configuration, it is possible to improve the shear rigidity in the vertical direction of the coupling casing most efficiently, thereby avoiding reduction in the rigidity of the coupling casing.

The screw compressor of the present invention may have the compressor body including a first compressor body and a second compressor body, a bull gear coupled to the input shaft so as to be accommodated in the gear box, a first pinion gear accommodated in the gear box, coupled to the shaft of the screw rotor of the first compressor body so that the axis of the first pinion gear is disposed above the axis of the bull gear, and engaging with the bull gear, and a second pinion gear accommodated in the gear box, coupled to the shaft of the screw rotor of the second compressor body so that the axis of the second pinion gear is disposed above the axis of the bull gear and on the opposite side of the first pinion gear with respect to a vertical line passing through the axis of the bull gear, and engaging with the bull gear.

Preferably, the coupling casing has a gear box side flange having a coupling face coupling to the gear box at one end in the axial direction, and a motor side flange having a coupling face coupling to the motor at the other end in the axial direction. Preferably, the rib is disposed in the direction orthogonal to the coupling face of the gear box side flange and the coupling face of the motor side flange. With this configuration, since the rib can be disposed in the direction orthogonal to the coupling face of the gear box side flange and the coupling face of the motor side flange, it is thus possible to reliably fix the rib to the coupling casing.

Preferably, the rib is disposed near the work hole. With this configuration, since the coupling casing has the rib near the work hole in which the shear rigidity in the vertical direction is low, it is thus possible to effectively compensate for the rigidity of the coupling casing.

Preferably, the plurality of ribs are provided. With this configuration, since the plurality of ribs are divided at the positions in which the shear rigidity in the vertical direction is low, it is thus possible to obtain the same effect as the case of providing only one rib by the smaller-weight material.

Preferably, the projected area of the rib onto an imaginary vertical plane is the same as the projected area of the work hole onto the imaginary vertical plane. With this configuration, it is possible to avoid reduction in the shear rigidity in the vertical direction of the coupling casing by the minimum-weight material.

Effect of the Invention

According to the present invention, since the coupling casing has the work hole in the horizontal direction and the rib extending in the up-down direction, it is thus possible to avoid reduction in the rigidity of the coupling casing with no cost increase, and to improve maintainability. In particular, since the coupling casing has the rib extending in the up-down direction, it is thus possible to improve the shear rigidity in the vertical direction of the coupling casing, and to avoid reduction in the rigidity of the coupling casing.

MODE FOR CARRYING OUT THE INVENTION

Embodiments of the present invention will now be described with reference to the drawings.

First Embodiment

Figure 1A:
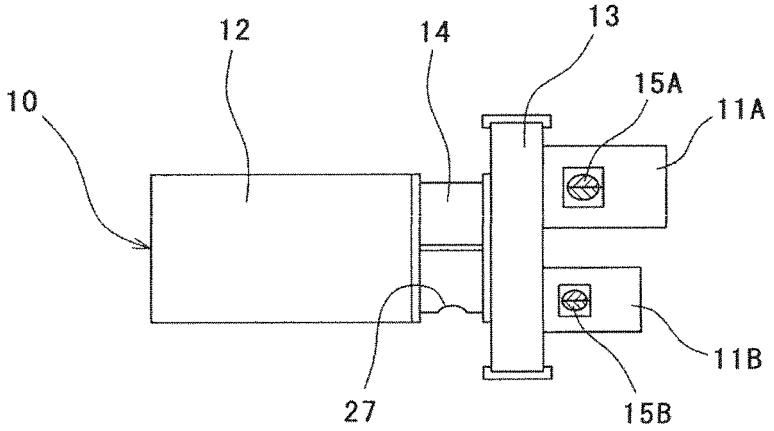
FIG. 1A is a plan view illustrating a screw compressor of a first embodiment of the present invention.
Figure 1B:
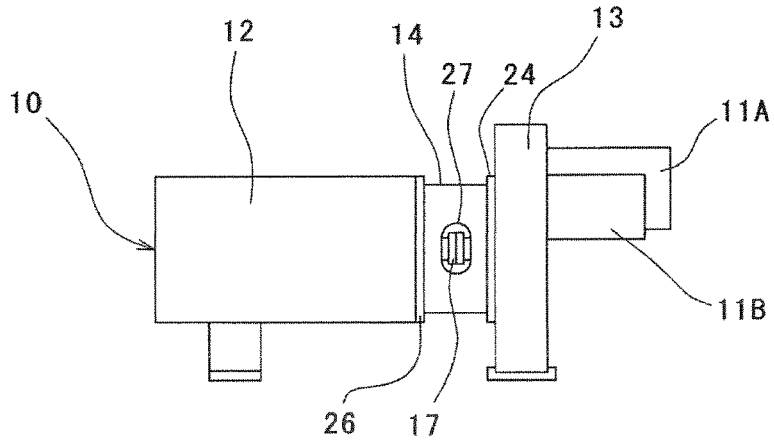
FIG. 1B is a side view illustrating the screw compressor of the first embodiment of the present invention.
Figure 1C:
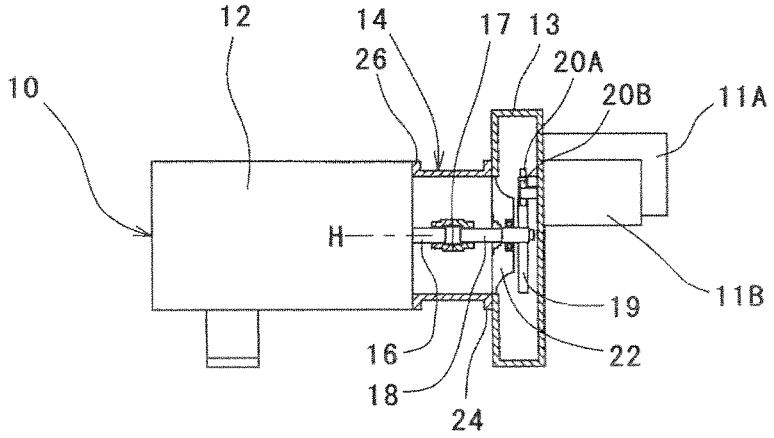
FIG. 1C is a side partial cross-sectional view illustrating the screw compressor of the first embodiment of the present invention.

FIGS. 1A to 1C illustrate a screw compressor of a first embodiment of the present invention. A screw compressor 10 has compressor bodies 11A, 11B, a motor 12, a gear box 13, and a coupling casing 14.

The compressor body 11A is a first compressor body 11A. The compressor body 11B is a second compressor body 11B. The compressor bodies 11A, 11B compress a fluid by screw rotors 15A, 15B.

The motor 12 is disposed in a side of the compressor bodies 11A, 11B, and supplies a drive force to the compressor bodies 11A, 11B. To a shaft 16 of the motor 12, an input shaft 18 is coupled through a coupling 17. The input shaft 18 inputs the drive force of the motor 12 to the gear box 13. The coupling 17 is accommodated in the coupling casing 14.

Figure 2:
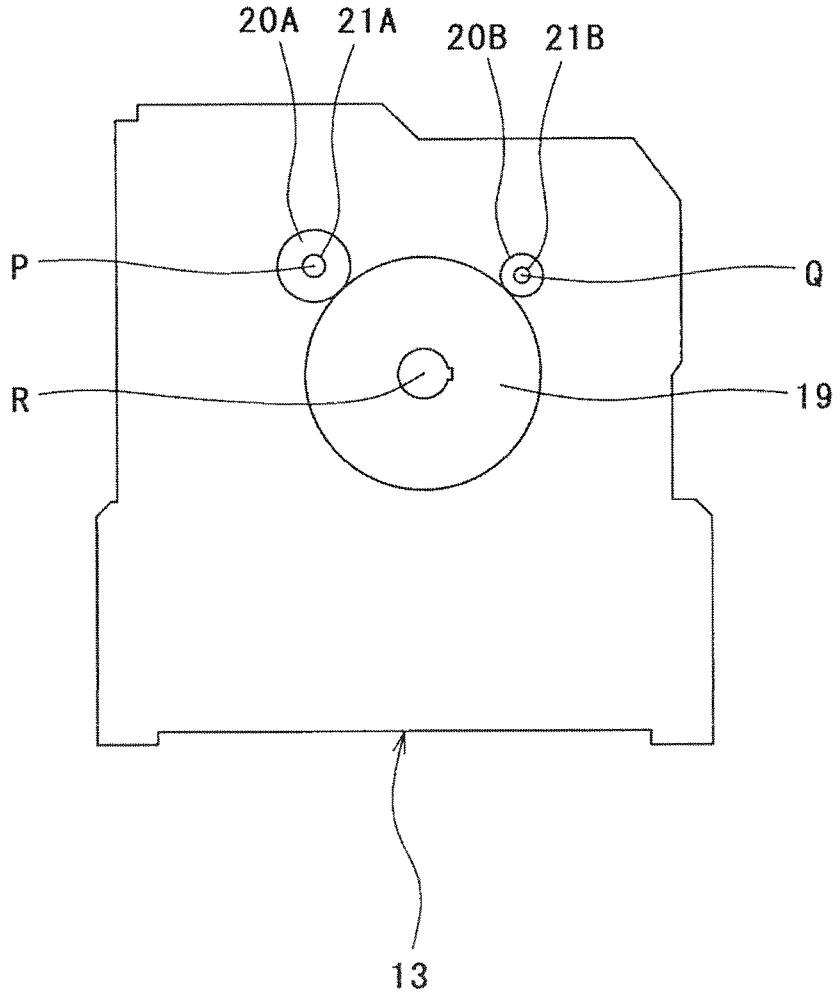
FIG. 2 is a side view illustrating the positional relationship between a bull gear, and a first pinion gear and a second pinion gear in a gear box.

The gear box 13 transmits the drive force of the motor 12 to the screw rotors 15A, 15B. The gear box 13 is coupled to the compressor bodies 11A, 11B. As illustrated in FIGS. 1C and 2, the gear box 13 accommodates a bull gear 19 and pinion gears 20A, 20B. The bull gear 19 is coupled to the input shaft 18 at the position opposite to the coupling 17. The first pinion gear 20A is coupled to a rotor shaft 21A of the screw rotor 15A of the first compressor body 11A, and engages with the bull gear 19. The second pinion gear 20B is coupled to a rotor shaft 21B of the screw rotor 15B of the second compressor body 11B, and engages with the bull gear 19. Axis P of the rotor shaft 21A is disposed above axis R of the bull gear 19. Axis Q of the rotor shaft 21B is disposed above axis R of the bull gear 19. The second pinion gear 20B is disposed on the opposite side of the first pinion gear 20A with respect to a vertical line passing through axis R of the bull gear 19. To the inside of the gear box 13, a gear box cover 22 is coupled. The gear box cover 22 rotatably supports the input shaft 18 through a bearing.

Figure 3:
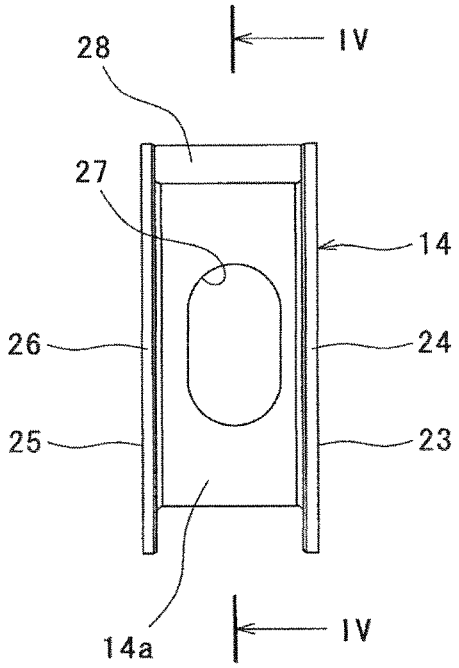
FIG. 3 is a side view of a coupling casing of the first embodiment.
Figure 4:
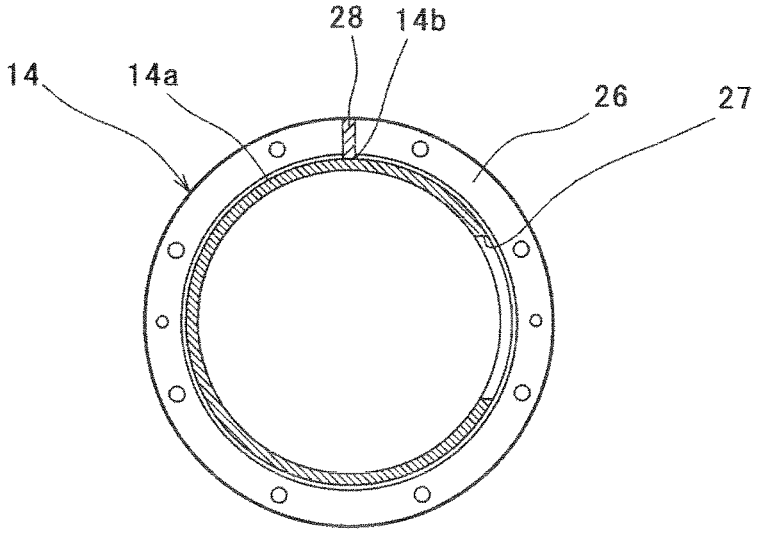
FIG. 4 is a cross-sectional view taken along line IV-IV in FIG. 3.

The coupling casing 14 is a tubular coupling casing that couples the gear box 13 and the motor 12 and is disposed to have horizontal axis H. The coupling casing 14 of this embodiment has a cylindrical shape. As illustrated in FIG. 3, the coupling casing 14 has a gear box side flange 24 having a coupling face 23 coupling to the gear box 13 at one end of a tube 14*a* in the axial direction. The coupling casing 14 has a motor side flange 26 having a coupling face 25 coupling to the motor 12 at the other end of the tube 14*a* in the axial direction. The gear box side flange 24, the motor side flange 26, and the coupling faces 23, 25 are substantially orthogonal to horizontal axis H of the coupling casing 14. The gear box side flange 24 has bolt holes to be fixed to the gear box 13. The motor side flange 26 has bolt holes to be fixed to the motor 12.

The coupling casing 14 has a work hole 27 in the horizontal direction used for maintaining the coupling 17. To facilitate the maintenance, the work hole 27 is disposed at the center in the up-down direction of the side face of the tube 14*a* in the coupling casing 14. The work hole 27 has an oval shape developed in a plane. In this context, the oval shape includes two equal-sized semicircular portions and two straight lines smoothly connecting the two semicircular portions. The work hole 27 is disposed so that the two semicircular portions are located in the up-down direction at the position corresponding to the coupling 17 in the axial direction.

The coupling casing 14 has a rib 28 extending in the vertical direction. The rib 28 is a substantially rectangular plate. The rib 28 has two side faces fixed to the gear box side flange 24 and the motor side flange 26 each, and a bottom face fixed to a top 14*b* of the tube 14*a*. That is, the rib 28 is disposed in the direction orthogonal to the coupling face 23 of the gear box side flange 24 and the coupling face 25 of the motor side flange 26.

When the motor 12 is operated, the drive force inputted from the input shaft 18 is transmitted from the bull gear 19 to the first pinion gear 20A and the second pinion gear 20B, and is then transmitted to the rotor shaft 21A of the screw rotor 15A of the first compressor body 11A, and to the rotor shaft 21B of the screw rotor 15B of the second compressor body 11B. The screw rotors 15A, 15B rotate to compress the fluid.

In the screw compressor 10 having the coupling casing 14, part of the weight of the motor 12 is applied, as a load, to the motor side coupling portion of the coupling casing 14. In addition, since the motor 12 and the gear box 13, which vibrate during operation, this causes a force to act on the coupling casing 14. In particular, the stress in the vertical direction is large.

The reason why the stress in the vertical direction is large is that the magnitude of the vibration of the gear box 13 is different from the magnitude of the vibration of the motor 12. As illustrated in FIG. 2, in the screw compressor 10 having the two compressor bodies 11A, 11B, the two pinion gears 20A, 20B are disposed above the bull gear 19 to transmit the drive force.

In the gears 19, 20A transmitting the drive force to the compressor body 11A, a separation force acts between the gears 19, 20A during driving. In the gears 19, 20B transmitting the drive force to the compressor body 11B, a separation force acts between the gears 19, 20B during driving. The force acts in the direction on an extension line connecting the center of the bull gear 19 and the center of the pinion gear 20A, and the center of the bull gear 19 and the center of the pinion gear 20B. Thus, when the screw compressor 10 is operated, the separation forces are added so that the force downward in the vertical direction becomes strong with respect to the input shaft 18 and the bull gear 19. This increases the vibration in the vertical direction in the gear box cover 22 on which the force acts through the input shaft 18 coupled to the bull gear 19. Consequently, the vibration in the vertical direction becomes large also in the gear box 13 to which the gear box cover 22 is coupled and also in the coupling casing 14 on the gear box 13 side.

Since the shaft 16 on the motor 12 side is coupled to the input shaft 18 by the coupling 17, this is unlikely to transmit the vibration from the input shaft 18 side to the motor shaft 16. Further, the motor 12, which has a large weight, is unlikely to vibrate, so that the vibration is small. From these results, the vibration in the vertical direction of the coupling casing 14 on the motor 12 side is small. Thus, the coupling casing 14 causes shear deformation in the vertical direction. Also in this case, since the coupling casing 14 has the rib 28 extending in the up-down direction, this improves the shear rigidity in the vertical direction of the coupling casing 14 and avoids reduction in the rigidity of the coupling casing 14.

The coupling casing 14 has the work hole 27 in the horizontal direction, and the rib 28 extending in the up-down direction. It is thus possible to avoid reduction in the rigidity of the coupling casing 14 with no cost increase, and to improve maintainability. In particular, since the coupling casing 14 has the rib 28 extending in the up-down direction, it is thus possible to improve the shear rigidity in the vertical direction of the coupling casing 14, to avoid reduction in the rigidity of the coupling casing 14.

The rib 28 can be disposed in the direction orthogonal to the coupling face 23 of the gear box side flange 24 and the coupling face 25 of the motor side flange 26. It is thus possible to reliably fix the rib 28 to the coupling casing 14.

Second Embodiment

Figure 5:
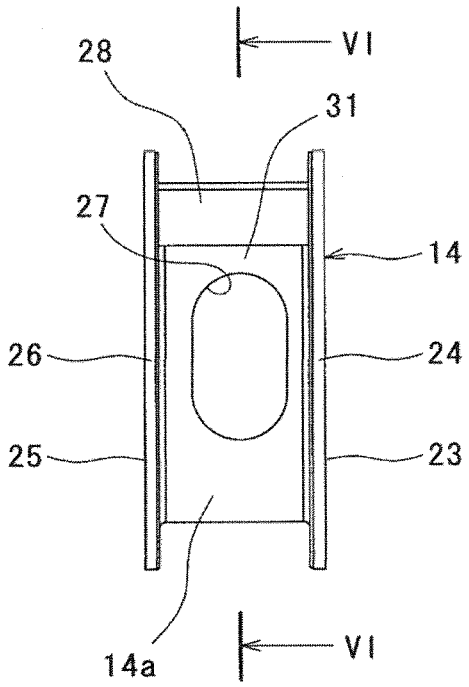
FIG. 5 is a side view of the coupling casing of a second embodiment.
Figure 6:
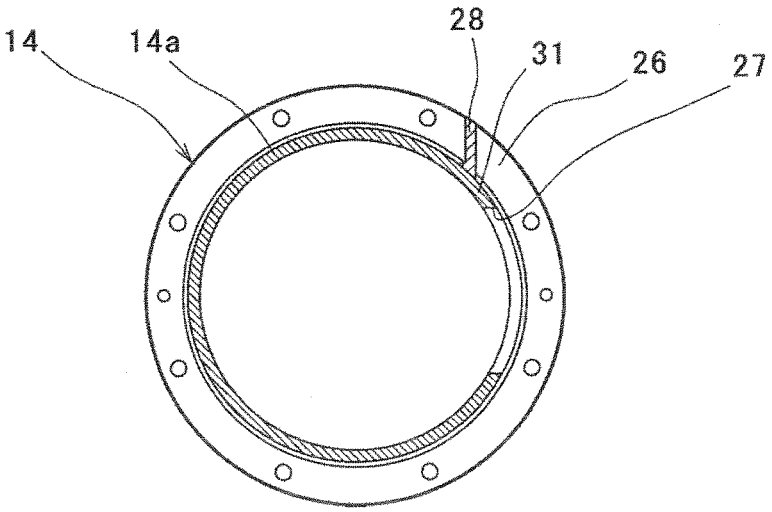
FIG. 6 is a cross-sectional view taken along line VI-VI in FIG. 5.

As illustrated in FIGS. 5 and 6, the rib 28 is disposed near the work hole 27 of the coupling casing 14. The rib 28 has two side faces fixed to the gear box side flange 24 and the motor side flange 26 each, and a bottom face fixed to a work hole upper end edge 31 of the tube 14*a*. With this configuration, since the coupling casing 14 has the rib 28 near the work hole 27 in which the shear rigidity in the vertical direction is low, it is thus possible to effectively compensate for the rigidity of the coupling casing 14.

Other configuration and operation of the second embodiment are the same as the first embodiment.

Third Embodiment

Figure 7:
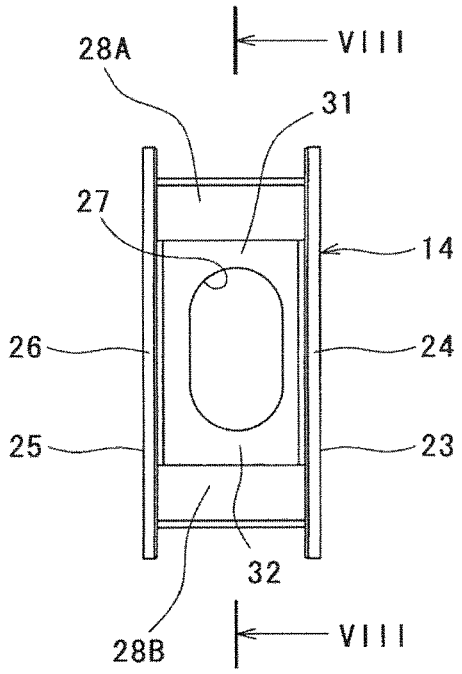
FIG. 7 is a side view of the coupling casing of a third embodiment.
Figure 8:
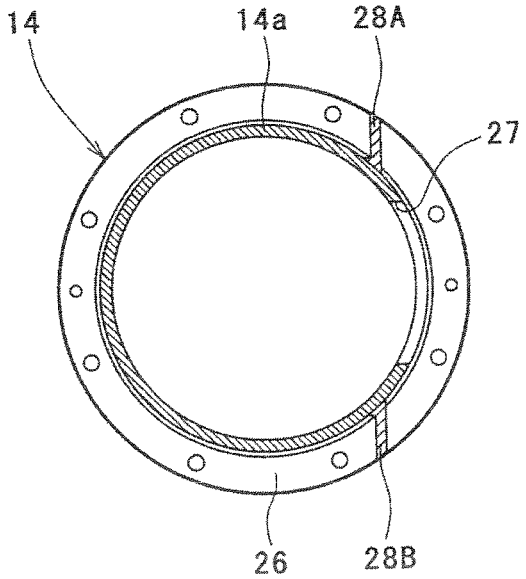
FIG. 8 is a cross-sectional view taken along line VIII-VIII in FIG. 7.

As illustrated in FIGS. 7 and 8, the coupling casing 14 has two ribs 28A, 28B. The two ribs 28A, 28B are disposed near the work hole 27 at the position in which the ribs 28A, 28B are symmetric with respect to a horizontal line passing through the axis of the coupling casing 14. The rib 28A has two side faces fixed to the gear box side flange 24 and the motor side flange 26 each, and a bottom face fixed to the work hole upper end edge 31 of the tube 14*a*. The rib 28B has two side faces fixed to the gear box side flange 24 and the motor side flange 26 each, and a bottom face fixed to a work hole lower end edge 32 of the tube 14*a*. With this configuration, since the plurality of ribs are divided at the positions in which the shear rigidity in the vertical direction is low, it is thus possible to obtain the same effect of avoiding reduction in the shear rigidity, as the case of providing only one rib, by the smaller-weight material.

Figure 9:
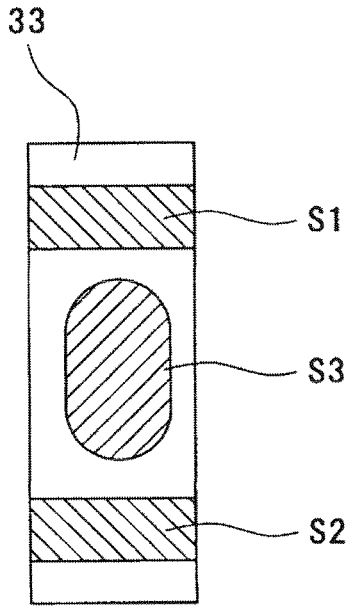
FIG. 9 is a diagram illustrating the projected areas of ribs and a work hole on an imaginary vertical plane.

In this embodiment, in particular, the coupling casing 14 can be configured as follows. The width of the ribs 28A, 28B has the same dimension as the length of the tube 14*a* in the axial direction. The thickness of the ribs 28A, 28B is the same as the thickness of the tube 14*a*. The height of the ribs 28A, 28B is set so that the projected areas of the ribs 28A, 28B onto an imaginary vertical plane 33 illustrated in FIG. 9 are the same as the projected area of the work hole 27 onto the imaginary vertical plane 33. That is, the total of area S1 of the rib 28A and area S2 of the rib 28B is the same as projected area S3 of the work hole 27 onto the imaginary vertical projection plane 33. With this configuration, it is possible to avoid reduction in the shear rigidity in the vertical direction of the coupling casing by the minimum-weight material.

Other configuration and operation of the third embodiment are the same as the second embodiment.

Fourth Embodiment

Figure 10:
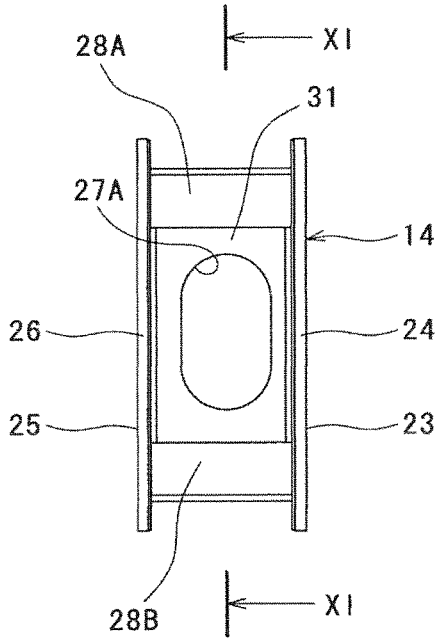
FIG. 10 is a side view of the coupling casing of a fourth embodiment.
Figure 11:
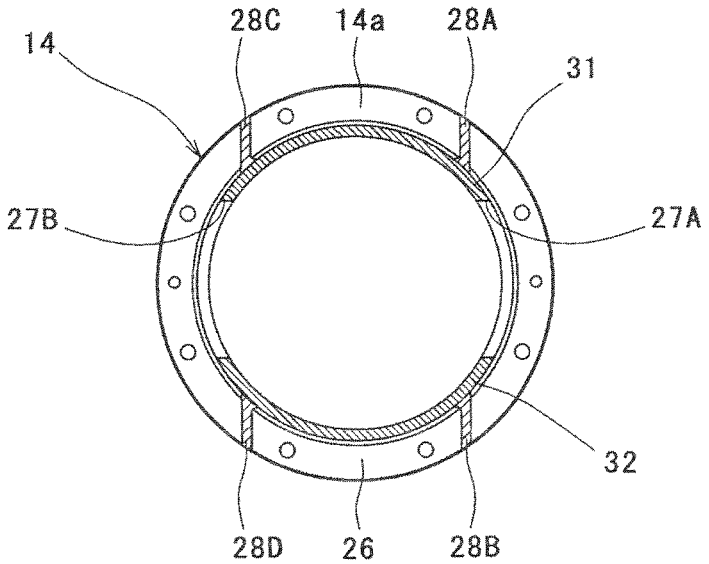
FIG. 11 is a cross-sectional view taken along line XI-XI in FIG. 10.

As illustrated in FIGS. 10 and 11, the coupling casing 14 has four ribs 28A to 28D. The coupling casing 14 also has work holes 27A, 27B disposed at the positions in which the work holes 27A, 27B are symmetric with respect to a vertical line passing through the axis of the coupling casing 14. Of the four ribs 28A to 28D, the two ribs 28A, 28B are disposed at the positions in which the ribs 28A, 28B are symmetric with respect to a horizontal line passing through the axis of the coupling casing 14, and near the work hole 27A. The remaining two ribs 28C, 28D are disposed at the positions in which the ribs 28C, 28D are symmetric with respect to a horizontal line passing through the axis of the coupling casing 14, and near the work hole 27B. The rib 28A is disposed at the position in which the rib 28A and the rib 28C are symmetric with respect to a vertical line passing through the axis of the coupling casing 14. The rib 28B is disposed at the position in which the rib 28B and the rib 28D with respect to a vertical line passing through the axis of the coupling casing 14. The ribs 28A, 28C each have two side faces fixed to the gear box side flange 24 and the motor side flange 26, and a bottom face fixed to the work hole upper end edge 31 of the tube 14*a*. The ribs 28B, 28D each have two side faces fixed to the gear box side flange 24 and the motor side flange 26, and a bottom face fixed to the work hole lower end edge 32 of the tube 14*a*.

Other configuration and operation of the fourth embodiment are the same as the third embodiment.

Fifth Embodiment

Figure 12:
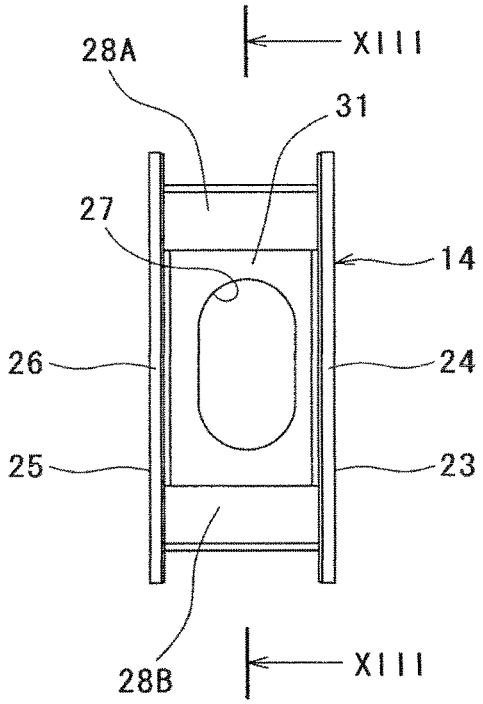
FIG. 12 is a side view of the coupling casing of a fifth embodiment.
Figure 13:
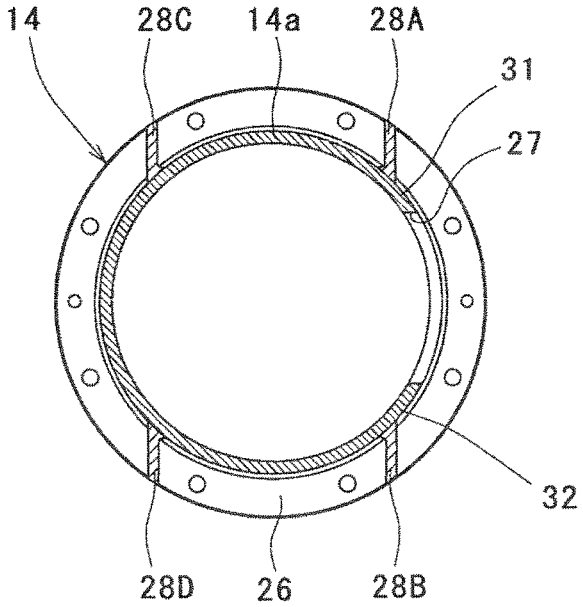
FIG. 13 is a cross-sectional view taken along line XIII-XIII in FIG. 12.

As illustrated in FIGS. 12 and 13, this embodiment is different from the fourth embodiment in that the coupling casing 14 has the work hole 27A, but does not have the work hole 27B.

Other configuration and operation of the fifth embodiment are the same as the fourth embodiment.

Sixth Embodiment

Figure 14:
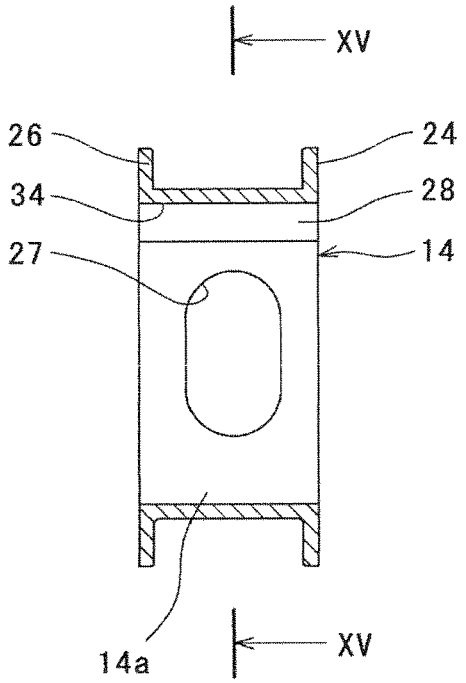
FIG. 14 is a longitudinal cross-sectional view of the coupling casing of a sixth embodiment.
Figure 15:
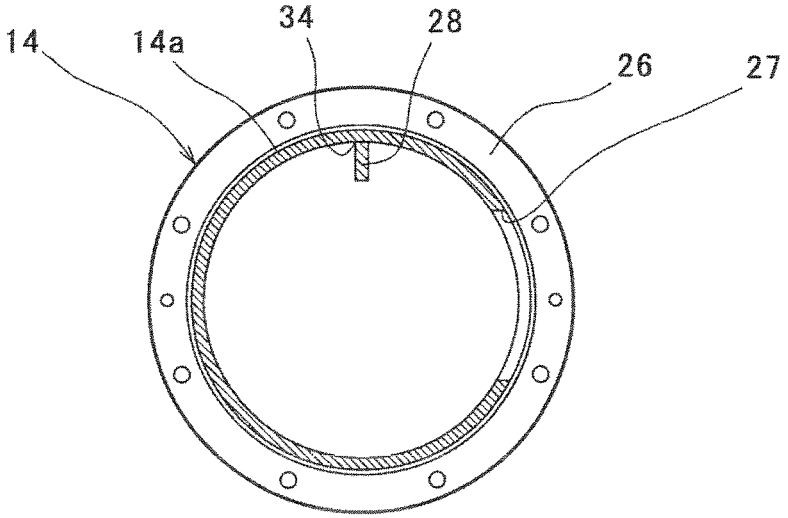
FIG. 15 is a cross-sectional view taken along line XV-XV in FIG. 14.

As illustrated in FIGS. 14 and 15, the rib 28 is disposed at an inner wall top 34 of the tube 14*a* of the coupling casing 14. The top face of the rib 28 is fixed to the inner wall top 34 of the tube 14*a*.

Other configuration and operation of the sixth embodiment are the same as the first embodiment.

Seventh Embodiment

Figure 16:
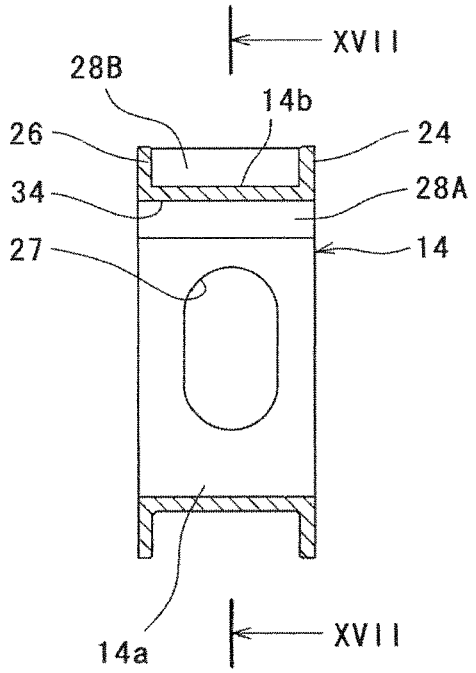
FIG. 16 is a longitudinal cross-sectional view of the coupling casing of a seventh embodiment.
Figure 17:
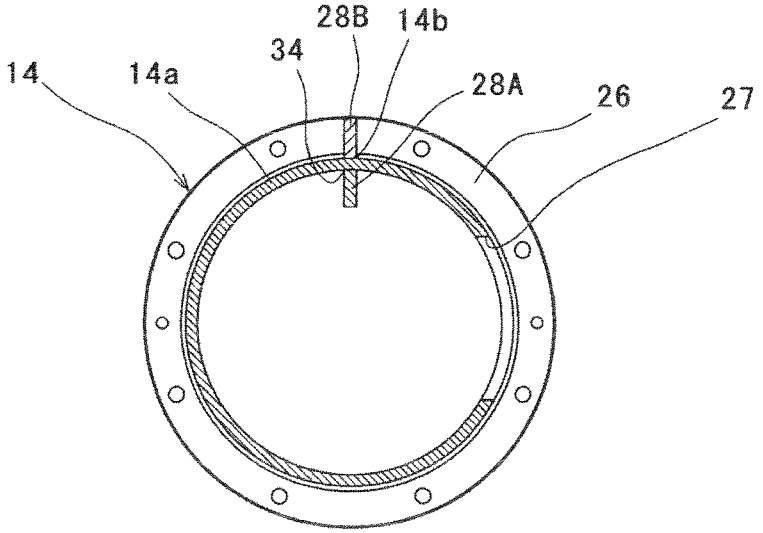
FIG. 17 is a cross-sectional view taken along line XVII-XVII in FIG. 16.

As illustrated in FIGS. 16 and 17, the coupling casing 14 has two ribs 28A, 28B. The rib 28A is disposed at the inner wall top 34 of the tube 14*a* of the coupling casing 14. The top face of the rib 28A is fixed to the inner wall top 34 of the tube 14*a*. The rib 28B has two side faces fixed to the gear box side flange 24 and the motor side flange 26 each, and a bottom face fixed to the top 14*b* of the tube 14*a*.

Other configuration and operation of the seventh embodiment are the same as the first embodiment.

The screw compressor of the present invention is not limited to the above embodiments, and various modifications can be made as follows.

Figure 18:
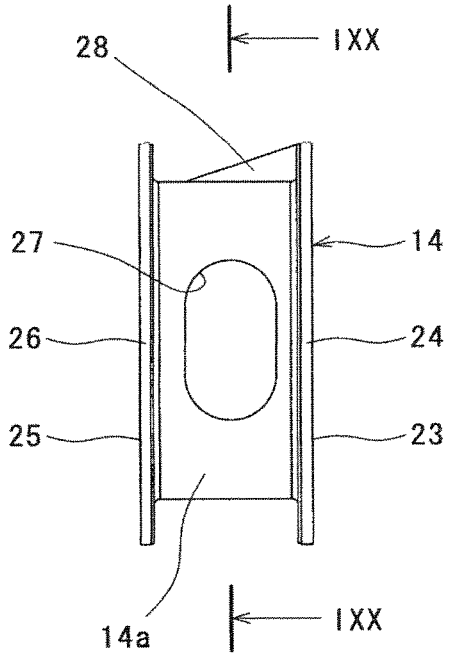
FIG. 18 is a diagram illustrating a modification of the present invention.
Figure 19:
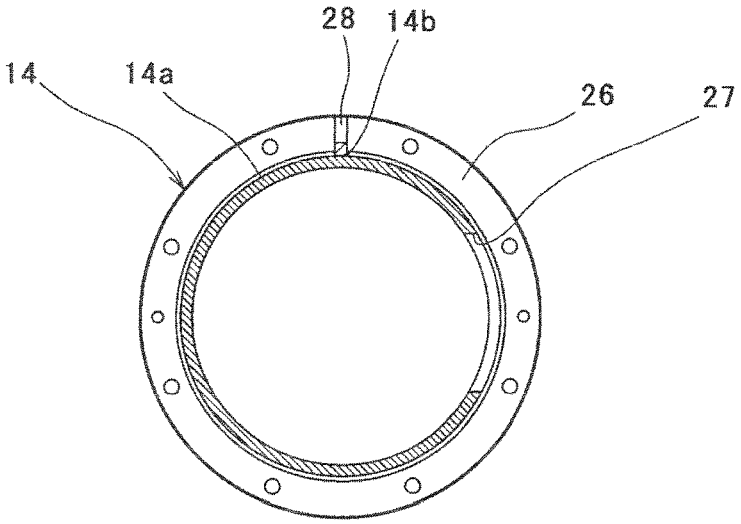
FIG. 19 is a cross-sectional view taken along line IXX-IXX in FIG. 18.

The rib 28 illustrated in the embodiments has a rectangular cross-sectional shape, but does not necessarily have a rectangular shape, and may be a triangular shape illustrated in FIGS. 18 and 19, or a polygonal shape.

The tubular coupling casing 14 may have a square tube, or an elliptical tube.

Figure 20:
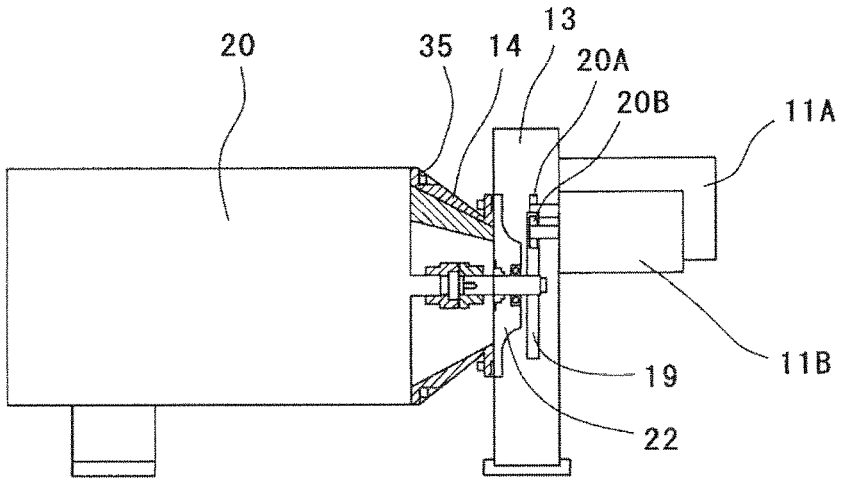
FIG. 20 is a diagram illustrating a modification of the present invention.
Figure 21:
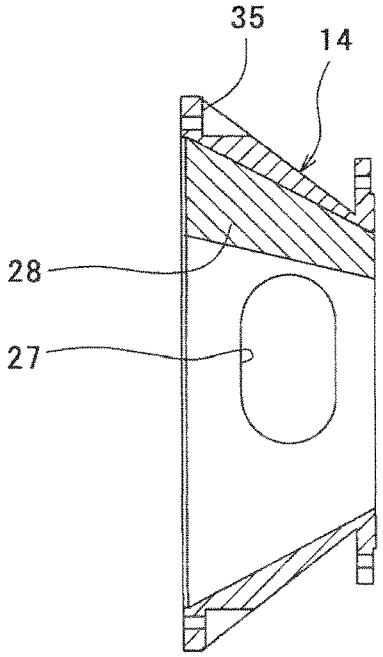
FIG. 21 is a cross-sectional view of the coupling casing of a modification of the present invention.

As illustrated in FIGS. 20 and 21, the coupling casing 14 is not required to have both or one of the gear box side flange 24 and the motor side flange 26. In this case, in place of the flanges 24, 26, the coupling casing 14 may have a counter boring 35. In addition, the rib 28 may be provided on the inner wall of the coupling casing 14.

The method of setting the size of the rib 28 illustrated in the third embodiment may be applied to other embodiments having a plurality of ribs 28, that is, to the fourth, fifth, and seventh embodiments.

Figure 22:
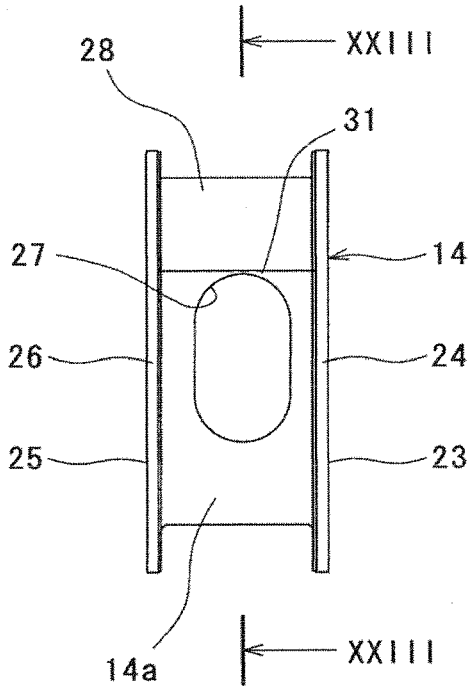
FIG. 22 is a side view of the coupling casing of a modification of the present invention.
Figure 23:
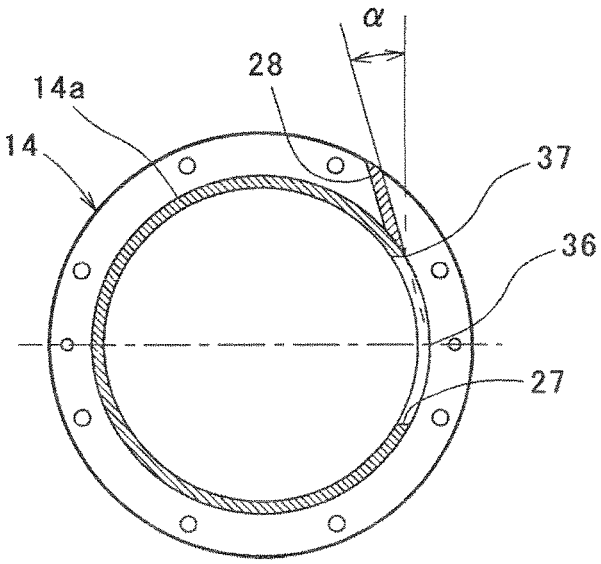
FIG. 23 is a cross-sectional view taken along line XXIII-XXIII in FIG. 22.

As illustrated in FIGS. 22 and 23, the rib 28 can be set to be tilted to the position parallel to a line connecting a center 36 of the work hole 27 on the outer wall face of the tube 14*a* and an upper end 37 of the work hole 27, that is, to angle $\alpha$ with respect to a vertical line seen in the axial direction. In this manner, the coupling casing 14 can have the rib 28 extending in the up-down direction. By tilting the rib 28 to angle $\alpha$, even when the projected area of the rib 28 onto the imaginary vertical plane is the same as the projected area of the work hole 27, the weight of the rib 28 cannot exceed the weight of the casing reduced by forming the work hole 27. It is thus possible to prevent cost increase.

The invention claimed is:

1. A screw compressor comprising:

a compressor body compressing a fluid by a screw rotor;

a motor disposed in a side of the compressor body and supplying a drive force to the compressor body;

a gear box coupled to the compressor body and transmitting the drive force of the motor to the screw rotor;

a tubular coupling casing coupling the gear box and the motor and having a horizontal axis;

an input shaft coupled to the shaft of the motor and inputting the drive force of the motor to the gear box;

a coupling accommodated in the coupling casing and coupling the input shaft and the shaft of the motor;

a work hole in the horizontal direction provided in the coupling casing and used for maintaining the coupling; and a rib provided in the coupling casing and extending in the up-down direction, the rib being a substantially rectangular plate and extending along an entire length of the tubular coupling casing in a horizontal direction.

2. The screw compressor according to claim 1, further comprising:

the compressor body including a first compressor body and a second compressor body;

a bull gear coupled to the input shaft so as to be accommodated in the gear box;

a first pinion gear accommodated in the gear box, coupled to the shaft of the screw rotor of the first compressor body so that the axis of the first pinion gear is disposed above the axis of the bull gear, and engaging with the bull gear; and a second pinion gear accommodated in the gear box, coupled to the shaft of the screw rotor of the second compressor body so that the axis of the second pinion gear is disposed above the axis of the bull gear and on the opposite side of the first pinion gear with respect to a vertical line passing through the axis of the bull gear, and engaging with the bull gear.

3. The screw compressor according to claim 1, wherein:

the coupling casing has a gear box side flange having a coupling face coupling to the gear box at one end in the axial direction, and a motor side flange having a coupling face coupling to the motor at the other end in the axial direction, and the rib is disposed in the direction orthogonal to the coupling face of the gear box side flange and the coupling face of the motor side flange.

4. The screw compressor according to claim 1, wherein the rib is disposed on the surface of the coupling casing at a position within 90 degrees about the input shaft from the proximate edge of the work hole.

5. The screw compressor according to claim 1, wherein the plurality of ribs are provided.

6. The screw compressor according to claim 1, wherein the projected area of the rib onto an imaginary vertical plane is the same as the projected area of the work hole onto the imaginary vertical plane.

* * * * *